US007049504B1

(12) United States Patent
Galoyan

(10) Patent No.: US 7,049,504 B1
(45) Date of Patent: May 23, 2006

(54) TREMOLEX

(76) Inventor: Jeff G. Galoyan, 1117 Corrie La., Walnut Creek, CA (US) 94597

( * ) Notice: Subject to any disclaimer, the term of this patent is extended or adjusted under 35 U.S.C. 154(b) by 36 days.

(21) Appl. No.: 10/908,665

(22) Filed: May 22, 2005

(51) Int. Cl.
*G10H 1/02* (2006.01)

(52) U.S. Cl. ..... 84/739; 84/313

(58) Field of Classification Search ..... 84/739, 84/313
See application file for complete search history.

(56) References Cited

U.S. PATENT DOCUMENTS 3,240,859 A * 3/1966 Rowe ..... 84/739
4,882,967 A 11/1989 Rose
4,967,631 A 11/1990 Rose
5,121,669 A * 6/1992 Iba et al. ..... 84/735
5,631,435 A 5/1997 Hutmacher
5,848,166 A * 12/1998 Fisher et al. ..... 381/62
2004/0163529 A1* 8/2004 Hyakutake et al. ..... 84/737

* cited by examiner

*Primary Examiner*—Jeffrey W Donels

(57) ABSTRACT

An electronic tremolo producing apparatus for stringed electronic musical instrument is provided. The tremolo apparatus includes an electronic base unit mounted on the instrument with an attached tremolo arm. The base unit and the tremolo arm are designed to be mounted at the location similar to mechanical tremolos and are operated in the same manner; however the pitch of the instrument is changed electronically. The tremolo arm moves similar to regular mechanical tremolos from the first position the second position to decrease the pitch of the instrument that is achieved electronically without decreasing the tension of the plurality of strings; the arm moves from the first position to the third position to electronically increase the pith of the instrument without increasing the tension of the plurality of strings. The base unit and the tremolo arm can be removed from the instrument and used with another one.

3 Claims, 5 Drawing Sheets

View 1

View 2

TREMOLEX

FIELD OF THE INVENTION

The present invention relates to an electronic musical instrument such as a string instrument and more particularly to an arrangement for electronically inducing a tremolo effect in the output of the musical instrument.

BACKGROUND FOR THE INVENTION

A variety of electronic methods for obtaining a tremolo effect have been proposed. A number of mechanical tremolos have been available with the emphasis in improving mechanical characteristics of the device.

U.S. Patent Application Publication No. 2004/0163529 by Hyakutake et al dated Aug. 26, 2004 discloses an electronic musical instrument which can realize a choking effect by a simple operation. The electronic musical instrument is constructed such that a neck provided with a fingerboard is fixed to a body. A plurality of fret operating elements are provided for each of six sounding channels. The body is provided with a string input section and an arm, and six stringed operating elements are provided for the respective sounding channels. For each sounding channel a tone generator generates a musical tone at a pitch determined by the corresponding fret operating element and the sounding timing determined by the corresponding stringed operating element. When the arm is operated a CPU provides control to apply a choking effect to a musical tone for a sounding channel in which the musical tone is being sounded by raising the pitch of the musical tone by a predetermined amount.

U.S. Pat. No. 5,848,166 issued to Fisher et al on Dec. 8, 1998 discloses an audio tremolo producing system that uses a rotating horn as a tremolo producing device for mid and high frequency audio signals, and an electronic tremolo producing device that is capable of both phase and amplitude modulation for low frequency signals.

U.S. Pat. No. 3,240,859 issued to Rowe on Mar. 15, 1966 discloses a transistorized tremolo unit being mounted entirely on the musical instrument for tremolo regulation, adjustment and control off the musical instrument.

U.S. Pat. No. 5,121,669 issued to Iba et al on Jun. 16, 1992 discloses an electronic stringed instrument that employs a plurality of sensors or monitors for instrument performance. Preferred sensors or monitors include a detector for detecting that a string of the instrument is vibrated, an apparatus for evaluating string-vibration strength or a string touch, an apparatus for discriminating a fret operation position on a fingerboard or a fundamental frequency of a vibration of the vibrated string, a tremolo arm sensor, and a string-bending sensor. These performance input parameters are assigned to various control functions for musical tones generated by a sound source and/or various control functions for effects added to these musical tones by an effector. The function assignment is preferably programmable. In an operation, a music control apparatus controls the sound source and/or effector in response to a performance monitor so that musical tones for the strings can be distinguished from each other or effects for the musical tones can be distinguished from each other. Therefore, a performance with the stringed instrument by a player can be fully expressed.

U.S. Pat. No. 4,882,967 issued to Rose on Nov. 28, 1989 discloses an improved mechanical tremolo apparatus for stringed musical instruments. The improved tremolo apparatus comprises a tremolo means to which a plurality of strings of the musical instrument are adapted to be secured for movement therewith; a means for mounting the tremolo means on the stringed musical instrument for movement from a first position to a second position to simultaneously decrease the tension of the plurality of the strings, and for movement from the first position to a third position to simultaneously increase the tension of the plurality of strings; a means for moving the tremolo means from the first position towards the second position and for moving the tremolo means from the first position towards the third position; a means for biasing the tremolo means in a direction to return the tremolo means to the first position when the tremolo means is moved towards the second position; and, a stop member movable between an inactive position, at which it is out of engagement with the tremolo means, and an active position at which it is in engagement with the tremolo means when the latter is at its first position. The stop member and the tremolo means are constructed and arranged so that when the stop member is in its active position, it precludes movement of the tremolo means from the first position toward the third position but allows movement of the tremolo means from the first position toward the second position.

However, the above relater arts do not provide means for obtaining a tremolo effect for a string musical instrument with a "stop-tail", that is for an instrument that does not have a factory equipped electronic or mechanical tremolo. The above related arts do not provide means for attaching a temporary and removable tremolo device to a string musical instrument that can use benefits of both mechanical and electronic tremolos.

SUMMARY OF INVENTION

It is therefore the object of the present invention to provide an electronic tremolo that can be attached to a string instrument and that can be operated similar to conventional mechanical tremolos. Particularly the present invention is intended to be used with type of electric guitars that are not provided with any kind of tremolos.

To attain the above objective in the first aspect of the present invention there is provided an electronic tremolo system consisting of a base unit equipped with a tremolo arm that is located between the bridge and the tailpiece of the musical instrument. That location ensures position of the tremolo arm at the usual place.

According to the second aspect of the present invention this tremolo device can be mounted on various types of string musical instruments. Among other instruments it is applicable to electrical-acoustical guitars that due to specific design normally do not have a separate bridge and a tailpiece. The base unit is mounted on an acoustical guitar by means of braces and clips to provide a steady and conventional location of the unit.

According to the third aspect of the present invention the tremolo effect is achieved electronically by means of the base unit which includes a potentiometer attached to the tremolo arm. The electric output of the instrument is being passed through the base unit that can control the pitch by changing the potentiometer parameters. By means of moving the tremolo arm from the first position down to the second position towards the body of musical instrument the potentiometer changes its position accordingly and lowers the pitch electronically. By moving the tremolo arm from the first position to the third position away from the body of the instrument the potentiometer changes its position accordingly and increases the pitch electronically. The user goes through the same motions as for a typical mechanical tremolo but achieves the tremolo effect electronically.

According to the forth aspect of the present invention the tremolo parameters such as the depth of the pitch can be regulated. The base unit that is mounted on the instrument is attached to a separate floor or rack unit which includes electronic schemes and circuits for processing the signal. The depth of the pitch is set by the floor unit and may be increased or decreased for the same range of mechanical movements of the arm.

According to the fifth aspect of the present invention physical efforts applied for moving the arm are regulated through a spring system inside the base unit. That adjusts the force applied to the tremolo arm from light to strong depending on personal preferences.

According to the sixth aspect of the present invention a number of other functions are assignable to the invention by means of switching modes on the floor/rack unit. The electronic tremolo can be turned off to allow for clean sound without alterations. It can be switched to a "volume" function for controlling the output level of the instrument. The floor unit can be switched to an "automatic tremolo" mode providing automatically varying pith by means of moving the tremolo arm from the first position towards the second or third position and holding it there without further movement.

According to the seventh aspect of the present invention the electronic tremolo includes means for mounting it between the bridge and the tailpiece of the most common types of electric guitars that are not equipped with tremolos as well as for mounting it on any other type of string musical instruments. This feature allows the usage of one unit with a number of instruments that an individual may own.

According to the eighth aspect of the present invention the electronic tremolo is considerably lighter than the mechanical one as it is made mostly of plastic materials. For a professional musical instrument the overall weight is one of the critical issues being considered by manufacturers.

According to the ninth aspect of the present invention the pitch of a string instrument is changed electronically and not by means of a mechanical change of the tension of strings. That eliminates detuning of strings due to mechanical movements and terminates a number of other unwanted consequences such as detuning of other strings when one string breaks, wear and tear, certain amount of applied physical efforts, etc. Though the pitch of the instrument is changed electronically it is still achieved by regular moving of a tremolo arm and does not require shifting attention for performing a new function.

Other objects, features and advantages of the invention will be apparent from the following description of embodiments thereof as illustrated in the accompanying drawings.

BRIEF DESCRIPTION OF THE DRAWINGS

One of the modes presently contemplated for carrying out the invention is illustrated in the accompanying drawings, in which.

DETAILED DESCRIPTION OF THE EMBODIMENT

The present invention will now be described in detail with reference to the drawings showing the preferred embodiment thereof.

Figure 1:
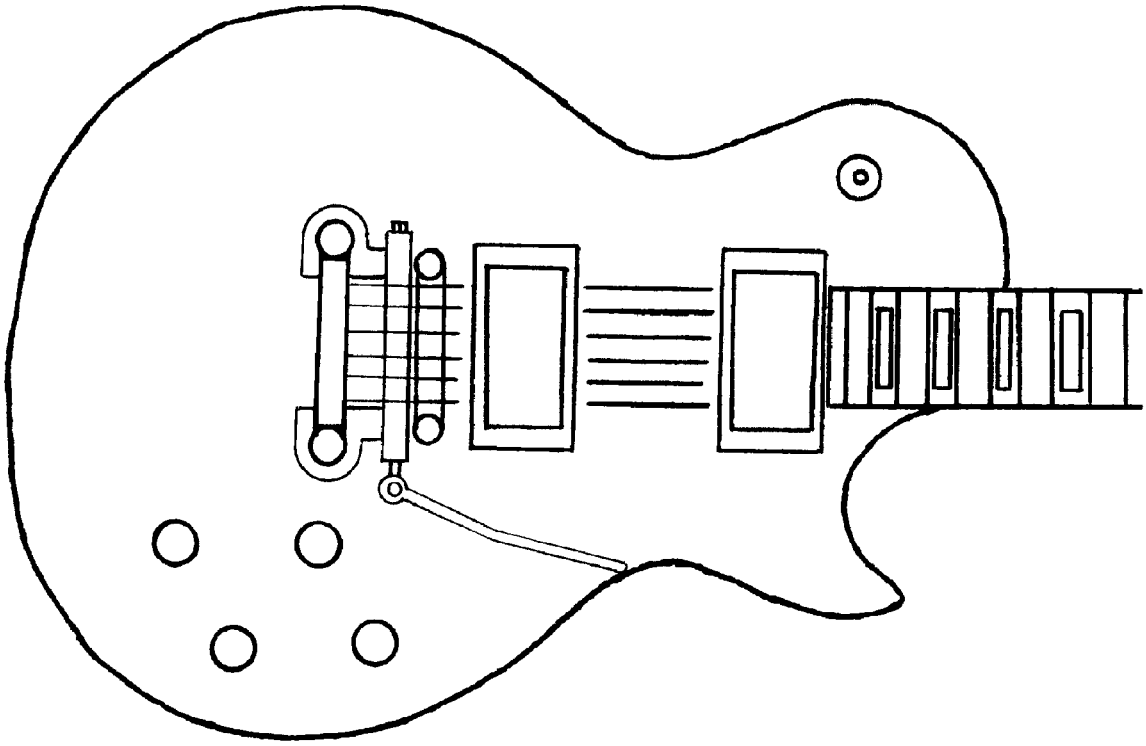
FIG. 1 is a general view of the present invention mounted on an instrument.

FIG. 1 shows the base unit mounted on a guitar that is not equipped with a tremolo. It is located between the bridge and the tailpiece. The location of the tremolo arm falls within the area where it is expected to be by a practiced user.

Figure 2:
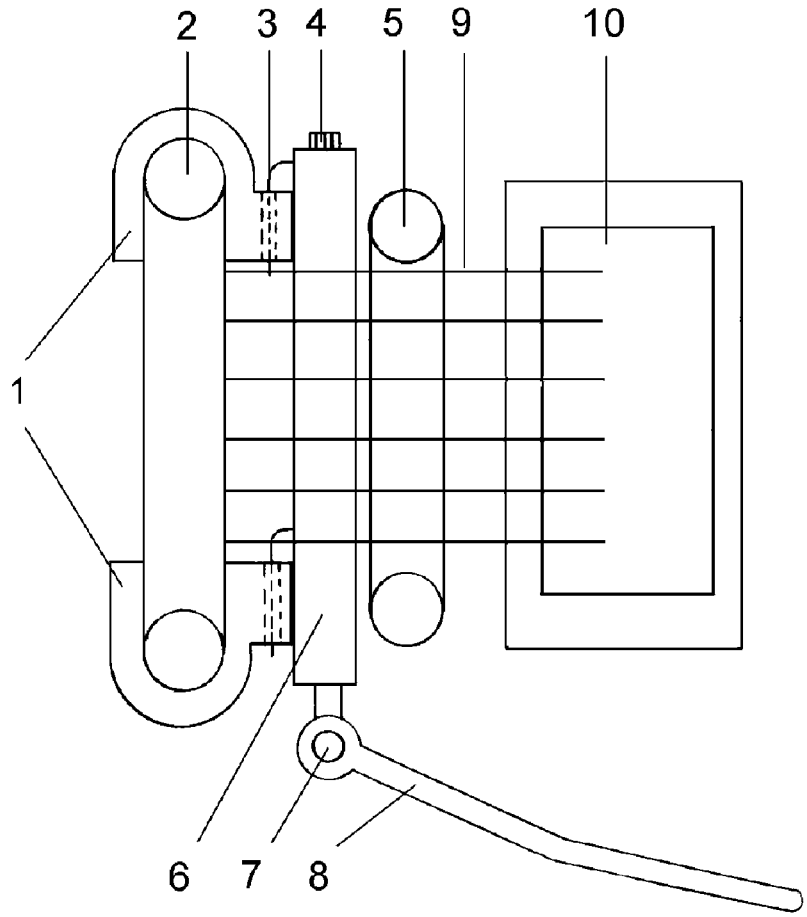
FIG. 2 is a close view of the base unit mounted between the bridge and tailpiece of a guitar.

FIG. 2 shows main components of the base unit 6 mounted between bridge 5 and tailpiece 2. Clips 1 are holding the base unit 6 at the required location. Clips 1 are attached to both ends of tailpiece 2 by snapping safely around bolts of the tailpiece without causing any damage to the instrument. Clips are located lower than strings 9 and are sitting on the body of the instrument. The side of clips 1 that is facing pickup 10 includes slots 11 for inserting the base unit 6 into required position by means of using brackets 3. That position ensures location of the tremolo arm 8 at the right area.

Figure 3:
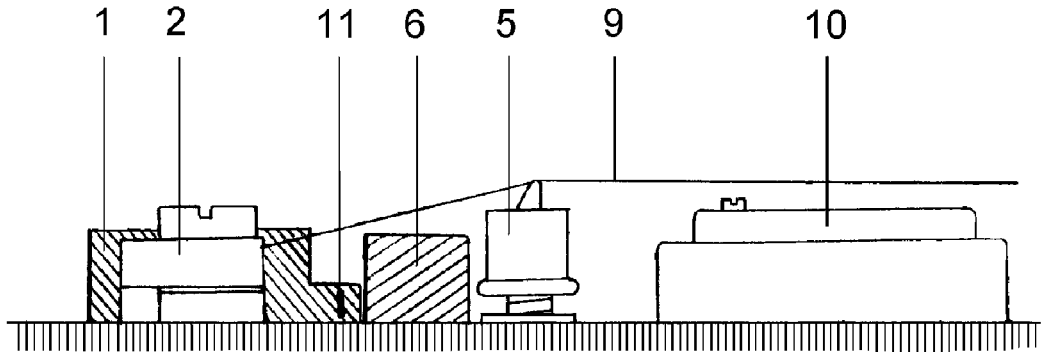
FIG. 3 is a side elevation view of the base unit located between the bridge and tailpiece.

FIG. 3 shows a section cut of the bridge area of the instrument depicted in FIG. 2. The base unit 6 is located under strings 9. Clip 1 is attached to the tailpiece 2 and extends toward pickup 10. Slot 11 is used for holding the base unit 6. Base unit 6 is located between bridge 5 and tailpiece 2. The top elevation of base unit 6 is low enough to avoid interference with strings 9. This location of the base unit allows replacement of strings, if need be, without dismantling the assembly.

Figure 4:
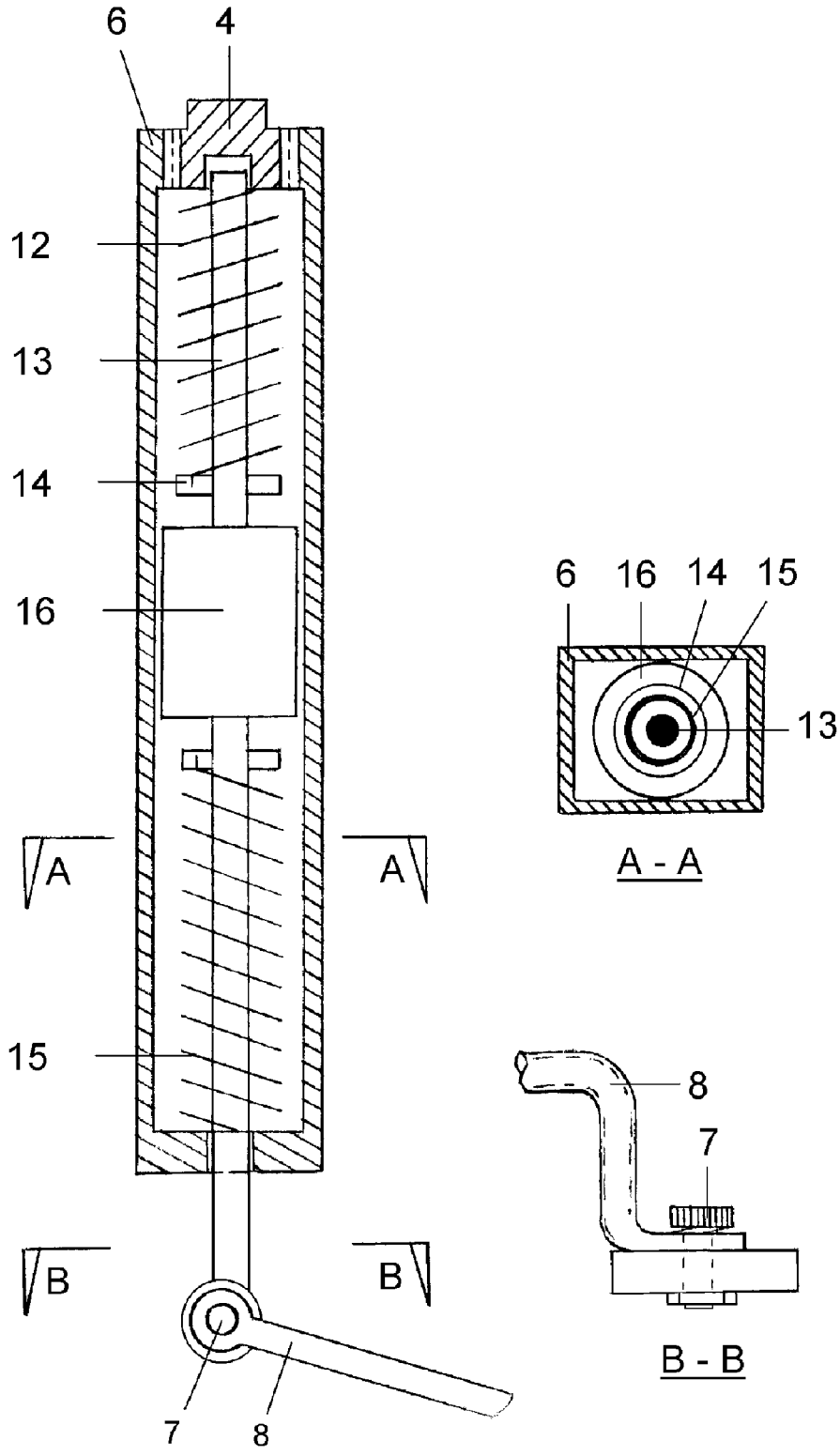
FIG. 4 is a section cut of the base unit.

FIG. 4 shows a section cut of the base unit 6. In the middle of the unit a potentiometer 16 is located which serves as the main component for electronically changing the pitch. Potentiometer shaft 13 is extended to both ends of the unit. The lower part of shaft 13 is extending through the edge base unit to be connected to a tremolo arm 8 by means of pivot 7. The upper end of the shaft is sitting in the recessed area of threaded cap 4. On both sides of potentiometer 16 the reversely positioned springs 12 and 15 are maintaining arm 8 in the middle position. Shaft 13 has spring stops 14 to hold one end of the spring. Springs 12 and 15 are working in the opposite directions to provide tension to the arm 8 in his movement up or down. Spring 12 is working when the arm 8 is moved down towards the body of guitar. Spring 15 is working when the arm 8 is moving away from the body of guitar. Tremolo arm 8 is attached to the shaft 13 through pivot bolt 7 which allows round movements of the arm 8 similar to conventional arms. Bolt 7 includes a spring washer that tightens up the arm 8 movements as much as it is required, or loosens it up accordingly. Threaded cap 4 can be removed in order to replace spring 12 with a heavier gage in case a stronger action is required for movement of the arm 8. By moving the tremolo arm 8 from neutral position towards the guitar body and from the guitar body the potentiometer's shaft 13 is being rotated. The rotated potentiometer 16 sends corresponding signals to the floor unit that processes the regular electronic output of the instrument and changes the pitch up or down accordingly.

Figure 5:
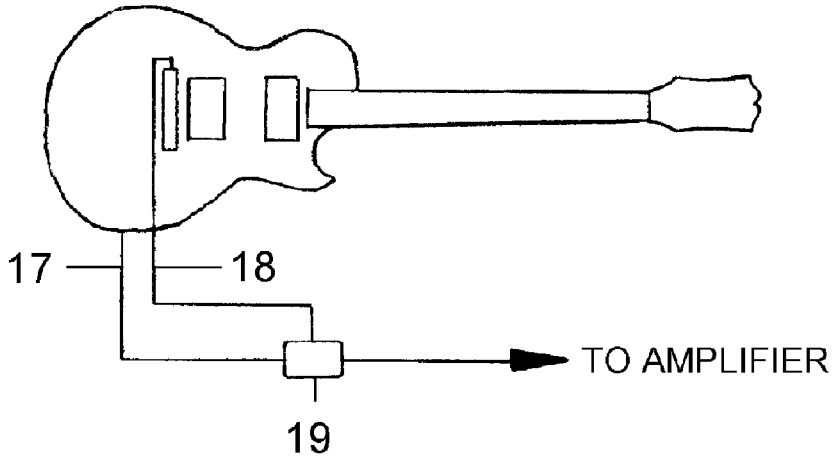
FIG. 5 is a schematic view of electrical connections of base unit to floor unit and subsequently to an amplifier.
Figure 5:
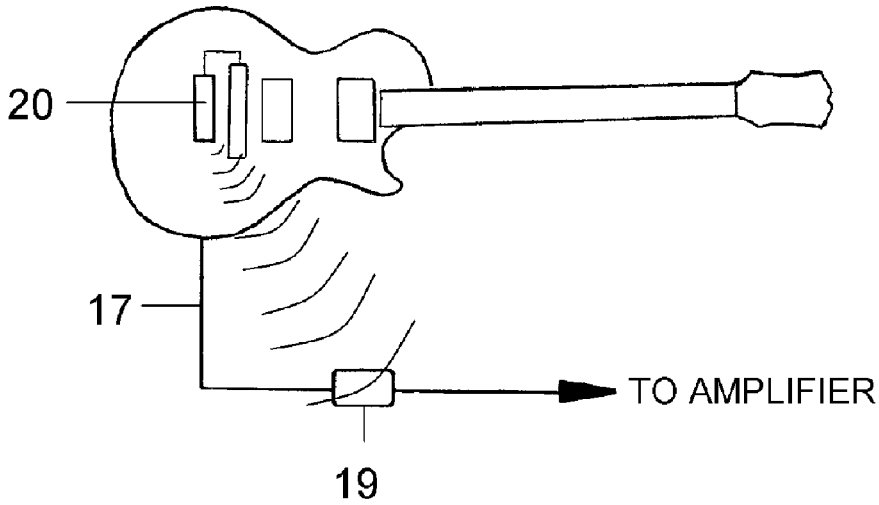

FIG. 5 schematically shows electrical connections of the present invention to the amplifier. The instrument's output is connected to the floor unit 19 with a regular output cable 17. In addition to that the base unit 6 is connected to the floor unit 19 with a separate cable 18 which transfers signals from potentiometer 16 controlling the pitch. When tremolo arm 8 is not used the output signal is passed unaltered through the floor unit 19 to the amplifier. As soon as the arm 8 moves up or down the signal from potentiometer 16 is being transferred to the floor unit 19 through cable 18 for shaping and changing the pitch. To avoid using additional cable line 18 a wireless unit 20 can be attached to the base unit for remotely controlling of the floor unit.

Figure 6:
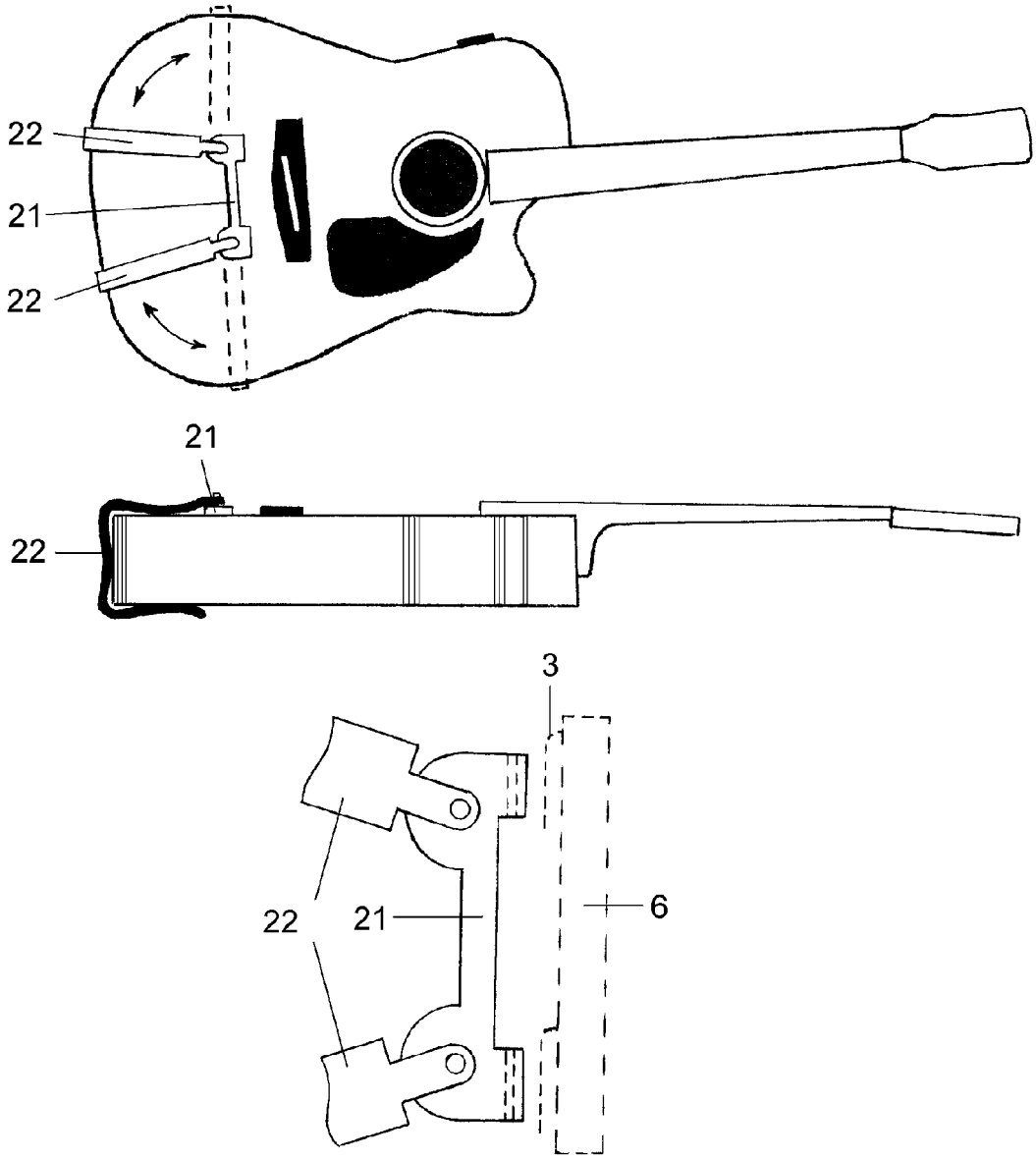
FIG. 6 is a front view of the base unit mounted on an acoustical-electrical guitar.

FIG. 6 shows a universal mounting kit that can be used for many types of instruments and particularly for acoustic-electric guitars. In this case a clip 21 is positioned at the bridge by means of braces 22. Clip 21 includes slots for inserting base unit 6 similar to clips 1 as shown in FIG. 2, maintaining the same dimensions to allow usage of the same base unit 6. Braces 22 can be adjusted to various thicknesses of guitar bodies and can move along the body of guitar to any position as shown by the arrow. Braces 22 are covered by a cushion material to avoid scratching and damaging of the instrument. In case the base unit must be used with a different instrument it can be un-inserted from the clips and moved to another instrument. Clips and braces can stay on the instrument for quickly returning the base unit back to the original place when needed. This mounting method can be used not only with acoustical guitars but with any other string musical instruments or electrical guitars that have various bridge-to-tailpiece configurations.

While the above disclosure sets forth a particular form of my invention it should be understood that I do not wish to be limited specifically thereto, since many modification may be made within the broad concepts of the invention, and I therefore contemplate by the appended claims to cover all such modifications as fall within the spirit and scope of my invention.

What is claimed is:

1. A tremolo producing system comprising: a base unit attached to the body of a string musical instrument in a manner of being capable of adjusting its position to varying guitar body configurations and being able to be removed from one instrument and be attached to another one; a tremolo arm attached to the said base unit for increasing or decreasing the pitch of the instrument by means of moving towards and from the body of the string instrument and capable of regulating the amount of physical efforts required to move the arm; a potentiometer positioned inside the said base unit and attached to the said tremolo arm to provide controlling signals for increasing or decreasing the pitch of the instrument electronically and without changing the tension of strings mechanically, said potentiometer being operable when said arm is moving from neutral position towards or from the body of musical instrument; a ground or rack unit positioned separate from the musical instrument and connected electronically to said base unit and also to said musical instrument to process the output signal of said musical instrument in relation to controlling signal received from the said base unit for increasing or decreasing the pitch of the instrument electronically following up movements of the said tremolo arm.

2. A tremolo producing system of claim 1 wherein the depth of the pitch can be regulated electronically and for the same range of mechanical movements of said tremolo arm can be dramatically increased or decreased producing a depth of tremolo modulation that can not be achieved through mechanical tremolos.

3. A tremolo producing system of claim 1 wherein the output is variable between at least two other type of modes including a mode for switching the tremolo modulation to a volume control operable by said tremolo arm, or a mode for providing an automatic tremolo function by moving said tremolo arm in any direction and simply holding it there with parameters of tremolo modulation being regulated from the ground/rack unit.

* * * * *